US010543969B2

(12) United States Patent
Gonzalez et al.

(10) Patent No.: US 10,543,969 B2
(45) Date of Patent: Jan. 28, 2020

(54) CARRIER FOR CONTAINERS

(71) Applicant: Graphic Packaging International, LLC, Atlanta, GA (US)

(72) Inventors: Ana Gonzalez, Barcelona (ES); Colin P. Ford, Woodstock, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 121 days.

(21) Appl. No.: 15/896,406

(22) Filed: Feb. 14, 2018

(65) Prior Publication Data

US 2018/0237197 A1 Aug. 23, 2018

Related U.S. Application Data

(60) Provisional application No. 62/460,239, filed on Feb. 17, 2017, provisional application No. 62/465,374, filed on Mar. 1, 2017.

(51) Int. Cl.
*B65D 5/48* (2006.01)
*B65D 5/42* (2006.01)
(Continued)

(52) U.S. Cl.
CPC ..... *B65D 71/0022* (2013.01); *B65D 5/4266* (2013.01); *B65D 5/4608* (2013.01);
(Continued)

(58) Field of Classification Search
CPC ..... B65D 71/0022; B65D 5/4266; B65D 5/48016; B65D 2571/00314;
(Continued)

(56) References Cited

U.S. PATENT DOCUMENTS 2,222,211 A 11/1940 Arneson
2,225,822 A 12/1940 Crook
(Continued)

FOREIGN PATENT DOCUMENTS

CA 2962433 A1 * 4/2016 ..... B65D 71/0022
DE 90 04 439 6/1990
(Continued)

OTHER PUBLICATIONS

International Search Report and Written Opinion for PCT/US2018/018117 dated May 29, 2018.

*Primary Examiner* — Rafael A Ortiz
(74) *Attorney, Agent, or Firm* — Womble Bond Dickinson (US) LLP

(57) ABSTRACT

A carrier for holding at least one container includes a plurality of panels extending at least partially around an interior space of the carrier and including a front panel, a back panel, at least one side panel, a first bottom panel, a second bottom panel, and at least one central panel. At least one divider flap extends from the at least one central panel to at least one of the front panel and the back panel. The first bottom panel includes at least one male locking feature and the second bottom panel includes at least one female locking feature for receiving the at least one male locking feature. The at least one male locking feature engages the at least one divider flap to lock the at least one divider flap in a generally perpendicular position relative to the central panel.

66 Claims, 12 Drawing Sheets

(51) Int. Cl.
*B65D 71/58* (2006.01)
*B65D 5/468* (2006.01)
*B65D 5/46* (2006.01)

(52) U.S. Cl.
CPC ..... *B65D 5/4612* (2013.01); *B65D 5/48016* (2013.01); *B65D 2571/0066* (2013.01); *B65D 2571/00314* (2013.01)

(58) Field of Classification Search
CPC ..... B65D 2571/00333; B65D 2571/00487; B65D 2571/0016; B65D 2571/00382; B65D 5/4612; B65D 5/4608
USPC ..... 206/181–188, 196, 193, 162, 173, 170, 206/174; 229/120.12, 120.04, 125.29, 229/117.01, 117.14–117.18
See application file for complete search history.

(56) References Cited

U.S. PATENT DOCUMENTS 2,227,330 A 12/1940 Turner
2,331,312 A 10/1943 Dorfman
2,336,857 A 12/1943 Gies et al.
2,457,308 A 12/1948 Hall et al.
2,460,108 A 1/1949 Smith et al.
2,660,361 A 11/1953 Tyrseck
2,689,061 A 9/1954 Gray
2,721,001 A 10/1955 Hasselhoff
2,772,020 A 11/1956 Kramer
2,776,072 A 1/1957 Forrer
2,783,916 A 3/1957 Hodapp
2,910,220 A 10/1959 Hamilton
2,991,908 A 7/1961 Conescu
2,993,619 A 7/1961 Arneson
3,029,977 A 4/1962 Arneson
3,053,411 A 9/1962 Struble et al.
3,128,906 A 4/1964 Forrer
3,190,487 A 6/1965 Wood
3,191,800 A 6/1965 Kowal
3,194,478 A 7/1965 Weiss
3,229,849 A 1/1966 Spillson
3,236,414 A 2/1966 Slevin, Jr.
3,313,466 A 4/1967 Keith
3,343,742 A 9/1967 Siegler
3,352,452 A 11/1967 Graser
3,432,073 A 3/1969 Forrer
3,554,401 A 1/1971 Wood
3,624,790 A 11/1971 Stout
3,651,982 A 3/1972 Slevin
3,661,297 A 5/1972 Wood
3,669,306 A 6/1972 Forrer
3,672,539 A 6/1972 Forrer
3,709,400 A 1/1973 Arneson
3,721,335 A 3/1973 Grant
3,722,738 A 3/1973 Wright
3,739,940 A 6/1973 Harrelson
3,754,680 A 8/1973 Wood
3,757,991 A 9/1973 Stout
3,784,053 A 1/1974 Stout
3,860,113 A 1/1975 Helms
3,893,565 A 7/1975 Rossi et al.
3,917,059 A 11/1975 Wood
3,917,060 A 11/1975 Wood
3,917,061 A 11/1975 Stout
4,000,813 A 1/1977 Stout
4,010,847 A 3/1977 Wood et al.
4,029,205 A 6/1977 Wood
4,153,158 A 5/1979 Graser et al.
4,171,046 A 10/1979 Bonczyk
4,187,944 A 2/1980 Wood
4,205,748 A 6/1980 Wilson
4,217,983 A 8/1980 Stout
4,243,138 A 1/1981 Wilson
4,250,992 A 2/1981 Gilbert
4,253,564 A 3/1981 Engdahl, Jr.
4,308,950 A 1/1982 Wood
4,318,470 A 3/1982 Montealegre
4,319,682 A 3/1982 Wright et al.
4,362,240 A 12/1982 Elward
4,374,561 A 2/1983 Stout et al.
4,377,252 A 3/1983 Schillinger
4,406,365 A 9/1983 Kulig
4,413,729 A 11/1983 Wood
4,450,956 A 5/1984 Wood
4,469,222 A 9/1984 Graser
4,480,746 A 11/1984 Wood
4,482,055 A 11/1984 Boyle
4,509,640 A 4/1985 Joyce
4,544,092 A 10/1985 Palmer
4,591,090 A 5/1986 Collins et al.
4,610,349 A 9/1986 Schwartz et al.
4,722,437 A 2/1988 Walsh
4,770,294 A 9/1988 Graser
4,782,943 A 11/1988 Blackman
4,782,944 A 11/1988 Engdahl, Jr.
4,792,038 A 12/1988 Cooper
4,927,009 A 5/1990 Stout
5,029,698 A 7/1991 Stout
5,040,672 A 8/1991 DeMaio et al.
5,072,876 A 12/1991 Wilson
5,123,588 A 6/1992 Harris
5,161,732 A 11/1992 Clein et al.
5,167,325 A 12/1992 Sykora
5,191,976 A 3/1993 Stout et al.
5,246,113 A 9/1993 Schuster
5,282,348 A 2/1994 Dampier et al.
5,359,830 A 11/1994 Olson et al.
5,363,954 A 11/1994 Dampier et al.
5,400,901 A 3/1995 Harrelson
5,439,110 A 8/1995 Regan, II
5,458,234 A 10/1995 Harris
5,482,203 A 1/1996 Stout
5,484,053 A 1/1996 Harris
5,499,712 A 3/1996 Harrelson
5,518,110 A 5/1996 Harrelson
5,531,319 A 7/1996 Harrelson
5,538,130 A 7/1996 Harrelson
5,538,131 A 7/1996 Harrelson
5,547,074 A 8/1996 Plaxico et al.
5,579,625 A 12/1996 Olson et al.
5,590,762 A 1/1997 Harrelson
5,593,027 A 1/1997 Sutherland
5,611,425 A 3/1997 Holley, Jr.
5,620,094 A 4/1997 Naumann
5,638,956 A 6/1997 Sutherland
5,645,162 A 7/1997 Harrelson
5,649,620 A 7/1997 Harrelson
5,657,864 A 8/1997 Harrelson
5,657,865 A 8/1997 Harrelson
5,680,930 A 10/1997 Stone
5,682,982 A 11/1997 Stonehouse
5,682,985 A 11/1997 Plaxico et al.
5,695,051 A 12/1997 Hart
5,709,298 A 1/1998 Harris
5,765,685 A 6/1998 Roosa
5,775,487 A 7/1998 Harrelson
5,819,920 A 10/1998 Sutherland
5,848,695 A 12/1998 Harris et al.
5,855,316 A 1/1999 Spivey
5,871,090 A 2/1999 Doucette et al.
5,878,877 A 3/1999 Sutherland
5,884,756 A 3/1999 Holley, Jr. et al.
5,941,377 A 8/1999 Hart et al.
5,947,273 A 9/1999 Dalrymple et al.
6,003,665 A 12/1999 Stout
6,041,920 A 3/2000 Hart et al.
6,112,977 A 9/2000 Sutherland et al.
6,131,729 A 10/2000 Eckermann et al.
6,155,962 A 12/2000 Dalrymple et al.
6,168,013 B1 1/2001 Gomes
6,230,881 B1 5/2001 Collura
6,247,585 B1 6/2001 Holley, Jr.
6,315,111 B1 11/2001 Sutherland

(56) References Cited

U.S. PATENT DOCUMENTS

| | | | |
|---|---|---|---|
| 6,321,906 | B1 | 11/2001 | Wein |
| 6,341,689 | B1 | 1/2002 | Jones |
| 6,371,287 | B1 | 4/2002 | Jones et al. |
| 6,571,941 | B2 | 6/2003 | Holley, Jr. |
| 6,695,137 | B2 | 2/2004 | Jones et al. |
| 6,736,260 | B2 | 5/2004 | Gomes et al. |
| 6,802,802 | B2 | 10/2004 | Woog |
| 6,814,228 | B2 | 11/2004 | Sutherland |
| 6,938,756 | B2 | 9/2005 | Schuster |
| 7,011,209 | B2 | 3/2006 | Sutherland et al. |
| 7,025,197 | B2 | 4/2006 | Sutherland |
| 7,070,045 | B2 | 7/2006 | Theelen |
| 7,128,206 | B2 | 10/2006 | Kohler |
| 7,134,547 | B2 | 11/2006 | Auclair |
| 7,207,934 | B2 | 4/2007 | Schuster |
| 7,234,596 | B2 | 6/2007 | Lebras |
| 7,374,038 | B2 | 5/2008 | Smalley |
| 7,448,492 | B2 | 11/2008 | Sutherland |
| 7,472,791 | B2 | 1/2009 | Spivey, Sr. |
| 7,552,820 | B2 | 6/2009 | Kohler |
| 7,604,116 | B2 | 10/2009 | Schuster |
| 7,644,817 | B2 | 1/2010 | Sutherland |
| 7,677,387 | B2 | 3/2010 | Brand et al. |
| 7,762,395 | B2 | 7/2010 | Sutherland et al. |
| 7,762,397 | B2 | 7/2010 | Coltri-Johnson et al. |
| 7,793,780 | B2 | 9/2010 | Smalley |
| 7,959,062 | B2 | 6/2011 | Auclair |
| 8,020,695 | B2 | 9/2011 | Brand |
| 8,297,437 | B2 | 10/2012 | Smalley et al. |
| 8,622,207 | B2 | 1/2014 | Smalley |
| 9,022,277 | B2 | 5/2015 | Hendricks et al. |
| 9,415,914 | B2 | 8/2016 | Holley, Jr. |
| 2002/0077236 | A1 | 6/2002 | Chalendar et al. |
| 2002/0117407 | A1 | 8/2002 | Holley |
| 2003/0111363 | A1 | 6/2003 | Theelen |
| 2003/0159950 | A1 | 8/2003 | Jones et al. |
| 2003/0213705 | A1 | 11/2003 | Woog |
| 2004/0026269 | A1 | 2/2004 | Cuomo |
| 2004/0050722 | A1 | 3/2004 | Schuster |
| 2004/0094435 | A1 | 5/2004 | Auclair et al. |
| 2005/0167292 | A1 | 8/2005 | Sutherland |
| 2005/0211577 | A1 | 9/2005 | Bakx |
| 2005/0218014 | A1 | 10/2005 | Schuster |
| 2005/0230273 | A1 | 10/2005 | Kohler |
| 2006/0091024 | A1 | 5/2006 | Cuomo |
| 2006/0148629 | A1 | 7/2006 | Cuomo |
| 2006/0157545 | A1 | 7/2006 | Auclair |
| 2006/0231440 | A1 | 10/2006 | Holley, Jr. |
| 2007/0000980 | A1 | 1/2007 | Oliveira |
| 2007/0017839 | A1 | 1/2007 | Sutherland |
| 2007/0029212 | A1 | 2/2007 | Smalley |
| 2007/0151873 | A1 | 7/2007 | Schuster |
| 2008/0210581 | A1 | 9/2008 | Brand |
| 2008/0265008 | A1 | 10/2008 | Holley |
| 2009/0008273 | A1 | 1/2009 | Smalley |
| 2010/0006458 | A1 | 1/2010 | Wilkins et al. |
| 2010/0072086 | A1 | 3/2010 | Smalley |
| 2010/0147932 | A1 | 6/2010 | Brand |
| 2011/0048975 | A1 | 3/2011 | Brand |
| 2012/0000913 | A1 | 1/2012 | Smalley et al. |
| 2014/0291386 | A1 | 10/2014 | Ikeda |
| 2015/0321816 | A1 | 11/2015 | Holley, Jr. |

FOREIGN PATENT DOCUMENTS

| | | |
|---|---|---|
| EP | 0 822 150 | 2/1998 |
| EP | 1 319 607 | 6/2003 |
| EP | 1 852 359 | 11/2007 |
| EP | 2 102 073 | 9/2010 |
| FR | 2 825 074 | 11/2002 |
| GB | 926874 | 5/1963 |
| WO | WO 97/05026 | 2/1997 |
| WO | WO 99/01356 | 1/1999 |
| WO | WO 2006/020525 | 2/2006 |
| WO | WO 2008/089124 | 7/2008 |
| WO | WO 2010/045287 A1 | 4/2010 |

* cited by examiner

CARRIER FOR CONTAINERS

CROSS-REFERENCE TO RELATED APPLICATION

This application claims the benefit of each of U.S. Provisional Patent Application No. 62/460,239, which was filed on Feb. 17, 2017, and U.S. Provisional Patent Application No. 62/465,374, which was filed on Mar. 1, 2017.

INCORPORATION BY REFERENCE

The disclosures of each of U.S. Provisional Patent Application No. 62/460,239, which was filed on Feb. 17, 2017, and U.S. Provisional Patent Application No. 62/465,374, which was filed on Mar. 1, 2017, are hereby incorporated by reference for all purposes as if presented herein in their entirety.

BACKGROUND OF THE DISCLOSURE

The present disclosure generally relates to carriers or cartons for holding and displaying containers. More specifically, the present disclosure relates to basket-style carriers that include at least one shape-retaining feature.

SUMMARY OF THE DISCLOSURE

According to one aspect of the disclosure, a carrier for holding at least one container comprises a plurality of panels extending at least partially around an interior space of the carrier and comprising a front panel, a back panel, at least one side panel, a first bottom panel, a second bottom panel, and at least one central panel. At least one divider flap extends from the at least one central panel to at least one of the front panel and the back panel. The first bottom panel includes at least one male locking feature and the second bottom panel includes at least one female locking feature for receiving the at least one male locking feature. The at least one male locking feature engages the at least one divider flap to lock the at least one divider flap in a generally perpendicular position relative to the central panel.

According to another aspect of the disclosure, a blank for forming a carrier for holding at least one container comprises a plurality of panels extending at least partially around an interior space of the carrier and comprising a front panel, a back panel, at least one side panel, a first bottom panel, a second bottom panel, and at least one central panel. At least one divider flap extends from the at least one central panel to at least one of the front panel and the back panel in the carrier formed from the blank. The first bottom panel includes at least one male locking feature and the second bottom panel includes at least one female locking feature for receiving the at least one male locking feature in the carrier formed from the blank. The at least one male locking feature engages the at least one divider flap to lock the at least one divider flap in a generally perpendicular position relative to the central panel in the carrier formed from the blank.

According to another aspect of the disclosure, a method of forming a carrier for holding at least one container comprises obtaining a blank comprising a plurality of panels that comprises a front panel, a back panel, at least one side panel, a first bottom panel, a second bottom panel, and at least one central panel. The plurality of panels further comprises at least one divider flap, and the first bottom panel includes at least one male locking feature and the second bottom panel includes at least one female locking feature. The method further comprises arranging the plurality of panels to extend at least partially around an interior space of the carrier, positioning the at least one divider flap to extend from the at least one central panel to at least one of the front panel and the back panel, and inserting the at least one male locking feature at least partially through the at least one female locking feature to engage the at least one divider flap.

BRIEF DESCRIPTION OF THE DRAWINGS

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to carriers, packages, constructs, sleeves, cartons, or the like, for holding and displaying containers such as jars, bottles, cans, etc. The containers can be used for packaging food and beverage products, for example. The containers can be made from materials suitable in composition for packaging the particular food or beverage item, and the materials include, but are not limited to, glass; plastics such as PET, LDPE, LLDPE, HDPE, PP, PS, PVC, EVOH, and Nylon; and the like; aluminum and/or other metals; or any combination thereof.

Carriers according to the present disclosure can accommodate containers of numerous different shapes. For the purpose of illustration and not for the purpose of limiting the scope of the disclosure, the following detailed description describes beverage containers (e.g., glass bottles) at least partially disposed within the carrier embodiments.

In this specification, the terms "lower," "bottom," "upper," "top," "front," and "back" indicate orientations determined in relation to fully erected carriers. Further, as described herein, cartons may be formed from blanks by overlapping multiple panels and/or end flaps. Such panels and/or end flaps may be designated herein in terms relative to one another, e.g., "first", "second", "third", etc., in sequential or non-sequential reference, without departing from the disclosure.

Figure 1:
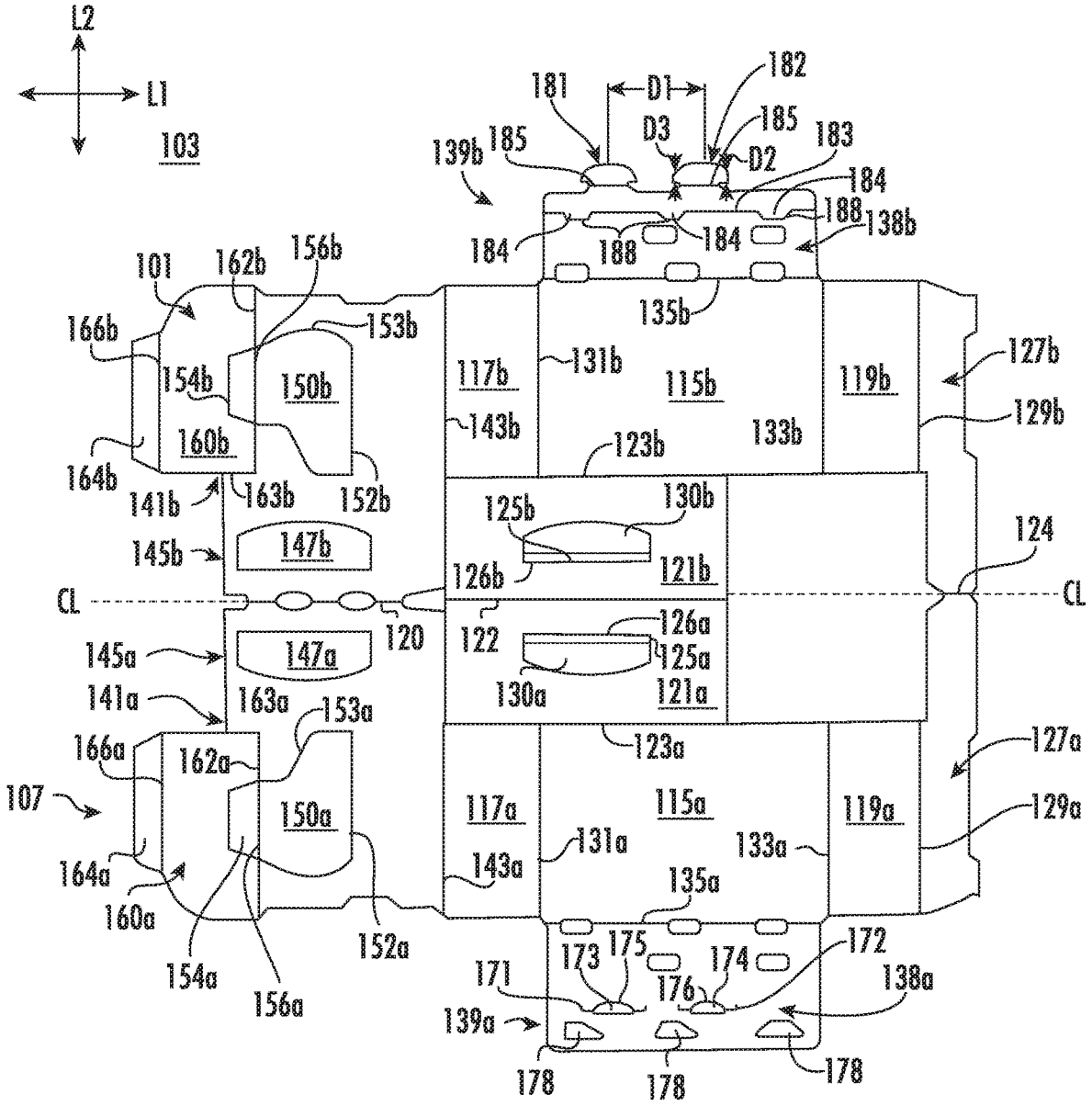
FIG. 1 is a plan view of an outer surface of a blank for forming a carrier according to a first exemplary embodiment of the disclosure.
Figure 8:
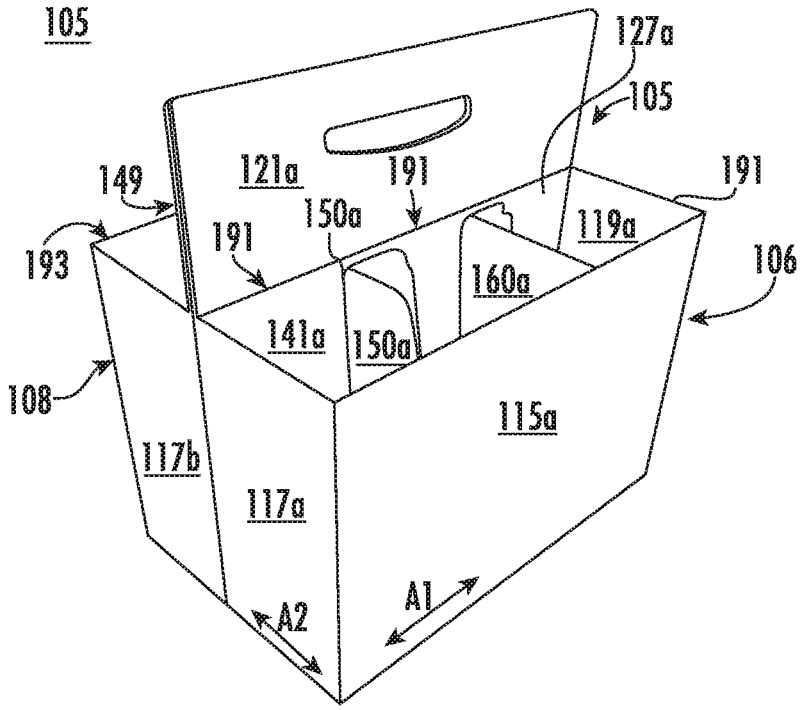
FIG. 8 is a perspective view of a carrier formed from the blank of FIG. 1.

FIG. 1 shows a plan view of an exterior side 101 of a blank 103 that can be obtained and used to form a package or basket-style carrier 105 (FIG. 8), in accordance with a first exemplary embodiment of the present disclosure. As shown in FIG. 8, the carrier 105 is sized to contain six containers, three containers being contained in a front portion 106 of the carrier 105 and three containers being contained in a back portion 108 of the carrier 105. In the illustrated embodiment, the containers can be beverage bottles, but the containers could be any other suitable type and size of container without departing from the disclosure. The carrier 105 may be sized and shaped to hold more or less than six containers, and/or in different arrangements, without departing from the disclosure. In one embodiment, the front portion 106 and the back portion 108 of the carrier 105 each have three containers. In other embodiments, the front portion 106 and the back portion 108 of the carrier 105 can hold more or less than three containers without departing from the disclosure.

As shown in FIG. 1, the blank 103 has a longitudinal axis L1 and a lateral axis L2. The blank 103 has a front portion 107 for forming the front portion 106 (FIG. 8) of the carrier 105, and a back portion 109 for forming the back portion 108 (FIG. 8) of the carrier 105. In one embodiment, the front portion 107 and the back portion 109 are disposed in opposing relation across the longitudinal centerline CL of the blank 103, as shown. Fold lines 120, 122, 124 can be disposed, e.g., collinearly, along portions of the centerline CL, as illustrated. As discussed in more detail below, the blank 103 is at least partially formed into the carrier 105 by folding the blank 103 about fold lines 120, 122, 124 along the centerline CL so that the front portion 107 and the back portion 109 of the blank 103 are at least partially overlapped.

In the illustrated embodiment, the front portion 107 of the blank 103 comprises a front panel 115*a* foldably connected to each of a first side panel 117*a* and a second side panel 119*a* at respective lateral fold lines 131*a*, 133*a*. The front portion 107 includes a front handle reinforcement flap 121*a* separated from the first side panel 117*a* and the front panel 115*a* by a cut 123*a*, and foldably connected to a central panel 141*a* at a fold line 144*a*. The front handle reinforcement flap 121*a* includes an opening 130*a* and a handle flap 125*a* foldably connected to the front handle reinforcement flap 121*a* at a fold line 126*a* and adjacent to the opening 130*a*. A keel 127*a*, as shown, is foldably connected to the second side panel 119*a* at a lateral fold line 129*a*.

The front portion 107 of the blank 103, as shown in FIG. 1, includes a front bottom panel 138*a* foldably connected to the front panel 115*a* at a longitudinal fold line 135*a*. In one embodiment, the first bottom panel 138*a* includes female locking features 139*a*. The female locking features 139*a*, as shown, include respective slits 171, 172 that partially define respective opening flaps 173, 174 foldably connected to the bottom panel 138*a* along respective curved fold lines 175, 176. The slits 171, 172 and respective opening flaps 173, 174 cooperate to receive respective secondary locking tab projections 181, 182 of a bottom panel 138*b* of the back portion 109 of the blank 103, as described herein. The secondary locking tab projections 181, 182, as shown, are spaced apart a longitudinal distance D1 to contact portions of the carrier 105 upon the formation of thereof, as described further herein. The female locking features 139*a* also include openings 178 that receive primary locking tab projections 184 of the bottom panel 138*b* of the back portion 109 of the blank 103, as described herein.

As shown in FIG. 1, the front portion 107 of the blank 103 includes the front or first central panel 141*a* foldably connected to the second side panel 119*a* at a lateral fold line 143*a*. The first central panel 141*a* that includes a handle portion 145*a* with handle features including a handle opening 147*a*. A first divider flap 150*a* (broadly, "third divider flap"), as shown, is foldably connected to the central panel 141*a* at a lateral fold line 152*a*. In the illustrated embodiment, the divider flap 150*a* is at least partially separable from the remainder of the central panel 141*a* as well as a portion of a second divider flap 160*a* (broadly, "first divider flap") at a line of weakening 153*a*. An adhesive flap 154*a*, as shown, is foldably connected to the divider flap 150*a* at a lateral fold line 156*a*. As shown, the second divider flap 160*a* at least partially separable from the central panel 141*a* at a longitudinal line of weakening 163*a* and is foldably connected to the central panel 141*a* at a lateral fold line 162*a*. An adhesive flap 164*a* is foldably connected to the divider flap 160*a* at a lateral fold line 166*a*. As shown, the line of weakening 153*a* of the first divider flap 150*a* interrupts the fold line 162*a* of the second divider flap 160*a*. The central panel 141*a* could be otherwise shaped, arranged, and/or configured, and could have other features, without departing from the disclosure.

In the illustrated embodiment, the features of the back portion 109 of the blank 103 include a back panel 115*b*, a first side panel 117*b*, a second side panel 119*b*, a keel 127*b*, and a central panel 141*b* that are generally a mirror-image of the corresponding panels or flaps of the front portion 107. Corresponding components (e.g., panels, flaps, fold lines, cuts, etc.) have been designated by corresponding reference numbers that differ by the "a" or "b" suffix, with the "a" components corresponding to the front portion 107 and the "b" components corresponding to the back portion 109 of the blank 103.

As shown in FIG. 1, and in contrast to the front portion 107, the back portion 109 of the blank 103 includes the bottom panel 138*b* having male locking features 139*b* and being foldably connected to the back panel 115*b* at a longitudinal fold line 135*b*. The male locking features 139*b* include the primary locking tab projections 184 that are at least partially defined along a line of weakening 183 of the bottom panel 138*b*, as shown. The projections 184 can be formed by tears or cuts 188 that extend between portions of the line of weakening 183. As described herein, the primary locking tab projections 184 are at least partially insertable through the openings 178 in the bottom panel 138*a*. The male locking features 139*b*, as shown, also include the secondary locking tab projections 181, 182 that are foldably connected to the bottom panel 138*b* at fold lines 185 and are at least partially insertable through the respective slits 171, 172 and/or openings 179 (FIG. 6) formed by the respective opening flaps 173, 174 of the bottom panel 138*a*, as described herein.

Any of the panels, flaps, fold lines, cuts, or other features could be otherwise shaped, arranged, and/or omitted from the blank 103 without departing from the disclosure. The blank 103 could be sized and/or shaped to accommodate more or less than six containers without departing from this disclosure.

Figure 2:
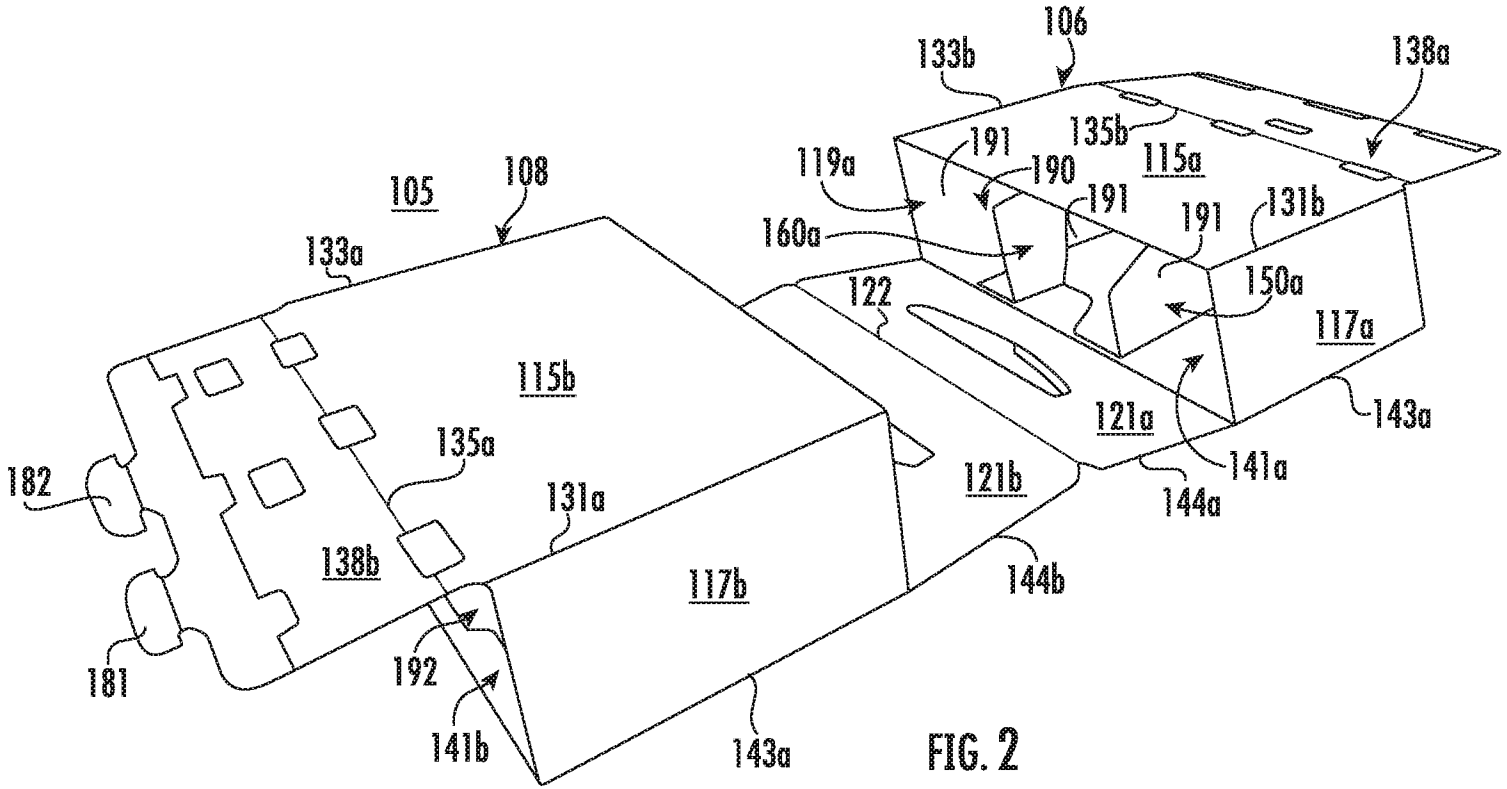
FIG. 2 is a first sequential perspective view of a formation of a carrier formed from the blank of FIG. 1.
Figure 3:
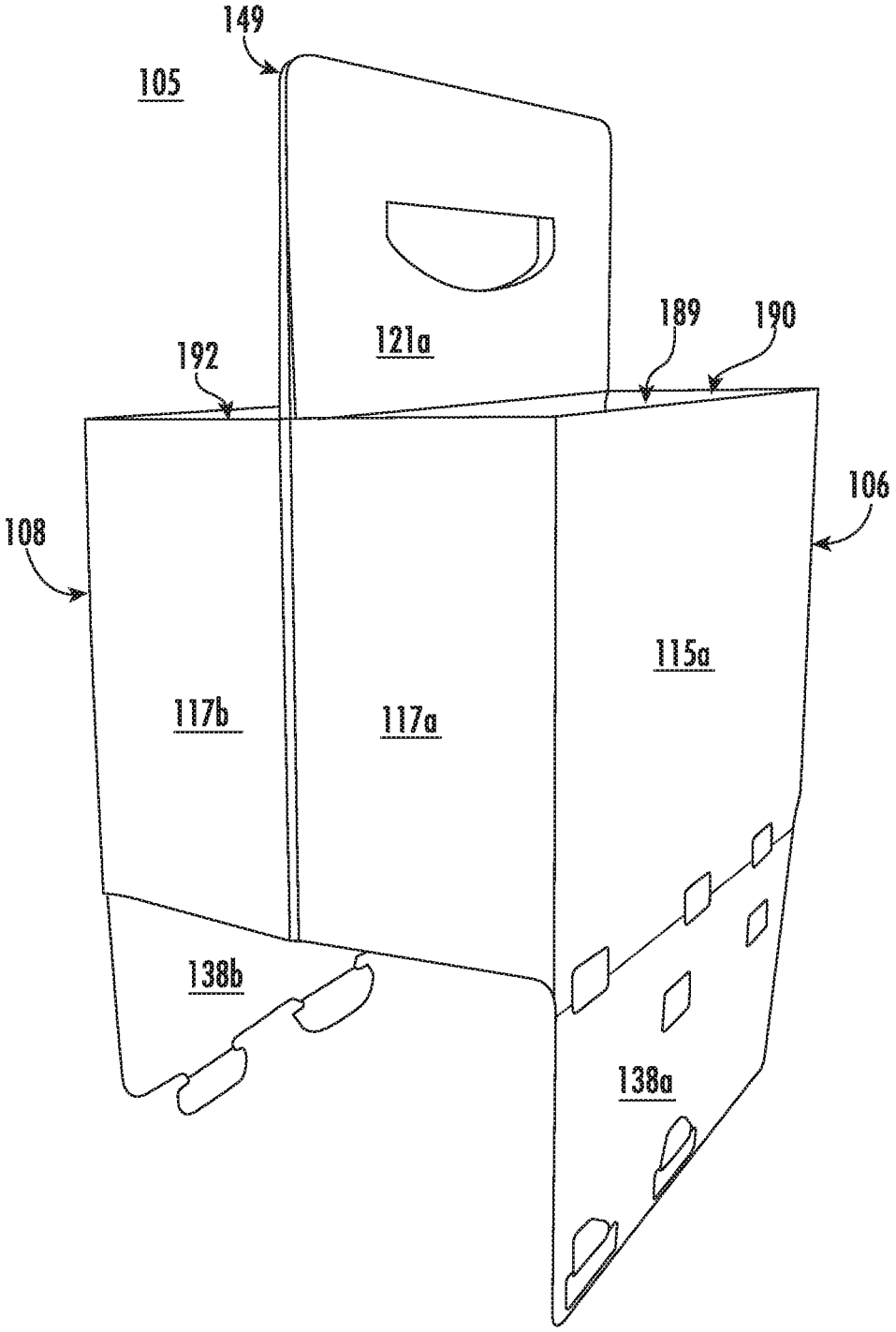
FIG. 3 is a second sequential perspective view of a formation of a carrier formed from the blank of FIG. 1.

Still referring to FIG. 1, and referring additionally to FIGS. 2 and 3, the carrier 105 can be erected from the blank 103 by folding the front panel 115*a*, the first side panel 117*a*, the second side panel 119*a*, the central panel 141*a*, and the keel 127*a* relative to one another to extend at least partially around an interior space 189 of the carrier 105. In the illustrated embodiment, the front panel 115*a*, the first side panel 117*a*, the second side panel 119*a*, the central panel 141*a*, and the keel 127*a* can be folded at respective fold lines 131*a*, 133*a*, 143*a*, and 142*a* such that the front panel 115*a* and the central panel 141*a* are substantially parallel to one another and the first side panel 117*a* and the second side panel 119*a* are substantially parallel to one another. The back panel 115*b*, the first side panel 117*b*, the second side panel 119*b*, the central panel 141*b*, and the keel 127*b* can also be folded relative to one another at respective fold lines 131*b*, 133*b*, 143*b*, and 142*b* such that the back panel 115*b* and the central panel 141*b* are substantially parallel to one another and the first side panel 117*b* and the second side panel 119*b* are substantially parallel to one another. The keels 127*a*, 127*b* are thus brought into proximity with and are generally coplanar to the respective central panels 141*a*, 141*b*, but the keels are maintained in relative separation. The respective handle reinforcement flaps 121*a*, 121*b* can be folded at the respective fold lines 144*a*, 144*b* and overlapped in at least partial face-to-face contact with the respective central panels 141*a*, 141*b* and the keels 127*a*, 127*b* such that the respective central panels and respective keels 141*a*, 127*a* and 141*b*, 127*b* are connected and with the handle openings 130*a*, 147*a* of the front portion 107 overlapped and substantially aligned and the handle openings 130*b*, 147*b* of the back portion 109 overlapped and substantially aligned such that a front interior portion or space 190 of the carrier 105 and a back interior portion or space 192 of the carrier 105 is formed. In such a configuration, the divider flap 150*a* can be separated from the central panel 141*a* and the second divider flap 160*a* at the line of weakening 153*a* and folded away from the central panel 141*a* at the fold line 152*a* to extend to the front panel 115*a* with the adhesive flap 154*a* folded at the fold line 156*a* into at least partial face-to-face contact with the front panel 115*a*, and the divider flap 160*a* can be separated from the central panel 141*a* at the line of weakening 163*a* and folded away from the central panel 141*a* at the fold line 162*a* to extend to the front panel 115*a* with the adhesive flap 164*a* folded at the fold line 166*a* into at least partial face-to-face contact with the front panel 115*a*. Similarly, the divider flap 150*b* (broadly, "fourth divider flap") can be separated from the central panel 141*b* and the second divider flap 160*b* (broadly, "second divider flap") at the line of weakening 153*b* and folded away from the central panel 141*b* at the fold line 152*b* to extend to the back panel 115*b* with the adhesive flap 154*b* folded at the fold line 156*b* into at least partial face-to-face contact with the back panel 115*b*, and the divider flap 160*b* can be separated from the central panel 141*b* at the line of weakening 163*a* and folded away from the central panel 141*b* at the fold line 162*b* to extend to the back panel 115*b* with the adhesive flap 164*a* folded at the fold line 166*a* into at least partial face-to-face contact with the back panel 115*b*. The adhesive flaps 154*a*, 164*a* can be secured, e.g., adhered, to the front panel 115*a* and the adhesive flaps 154*b*, 164*b* can be secured to the back panel 115*b*. In such an arrangement, three container-receiving spaces 191 are defined in the front interior space 190 of the carrier 105 and three container-receiving spaces 193 are defined in the back interior space 192 of the carrier 105.

In the illustrated embodiment, the front portion 106 and the back portion 108 of the partially-formed carrier 105 having an open bottom can be folded about fold lines 120, 122, and 124 along the centerline CL of the blank 103 so that the respective central panels 141*a*, 141*b* and keels 127*a*, 127*b* are brought into overlapping and at least partial face-to-face contact and adhered to one another, for example, with an adhesive. A handle 149, as shown, is formed by portions of the central panels 141*a*, 141*b*, the keels 127*a*, 127*b*, and the handle reinforcement flaps 121*a*, 121*b*, and extends upwardly along a central portion of the carrier 105. As illustrated, the carrier 105 is provided having an open configuration with bottom panels 138*a* and 138*b* disengaged from one another.

Figure 4:
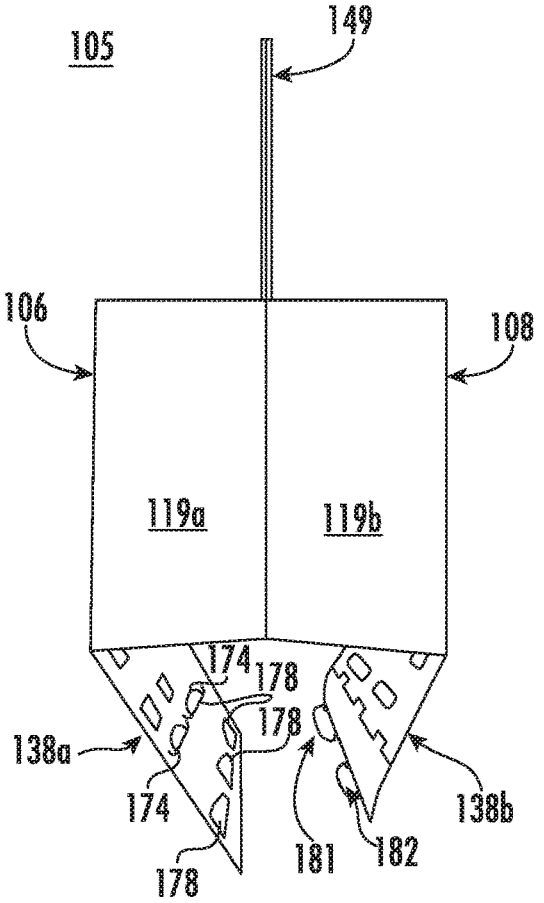
FIG. 4 is a third sequential perspective view of a formation of a carrier formed from the blank of FIG. 1.
Figure 5:
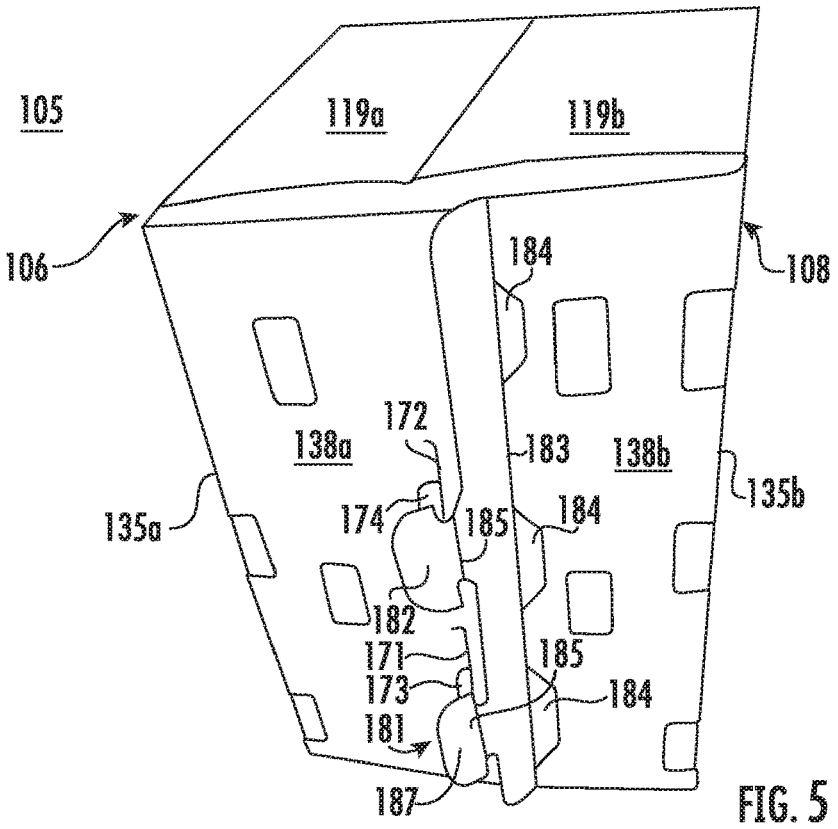
FIG. 5 is a fourth sequential perspective view of a formation of a carrier formed from the blank of FIG. 1.
Figure 6:
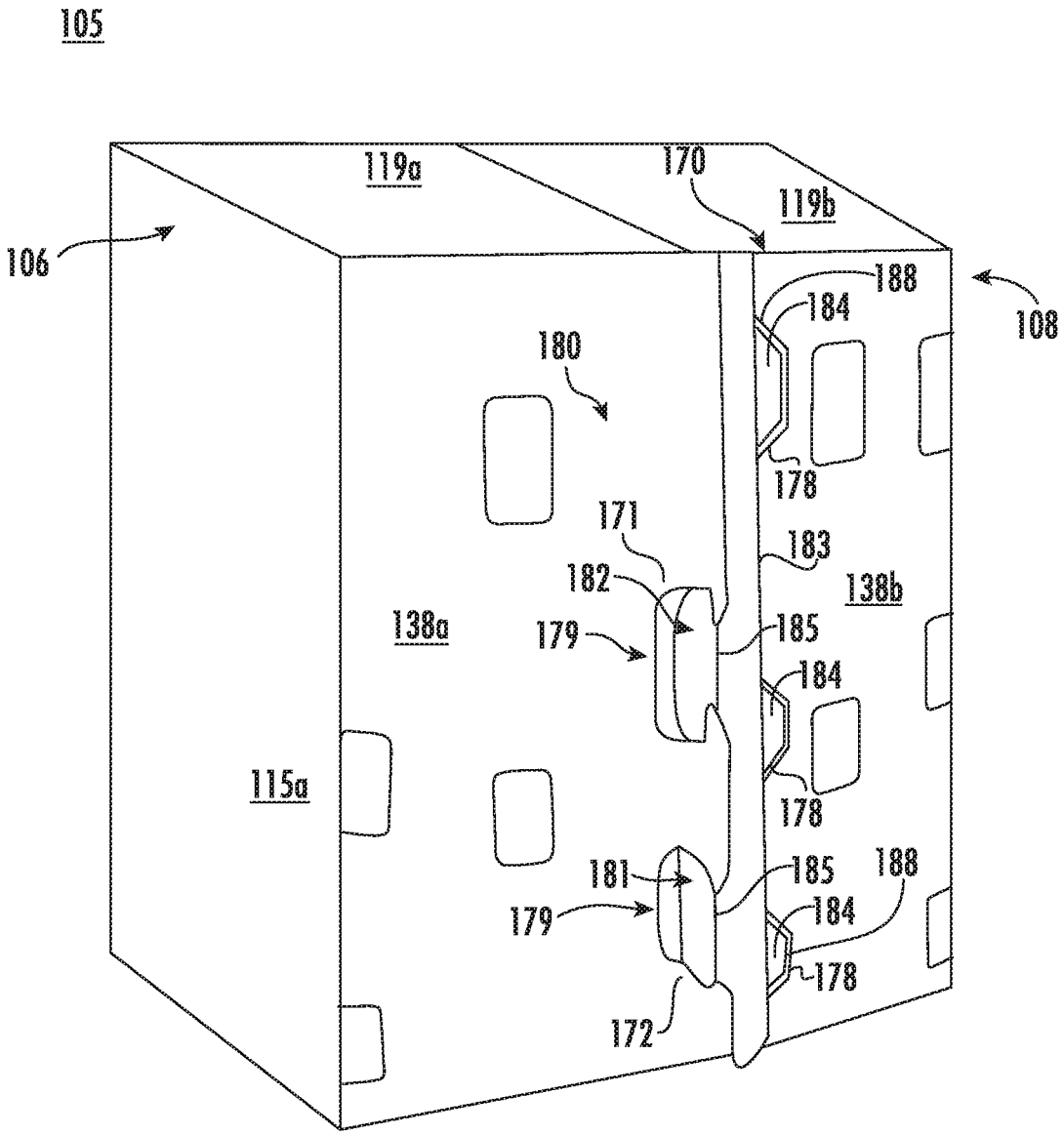
FIG. 6 is a fifth sequential perspective view of a formation of a carrier formed from the blank of FIG. 1.

With additional reference to FIGS. 4-6, closure of the bottom of the carrier 105 will be described according to one exemplary embodiment of the disclosure. The bottom panels 138*a*, 138*b* can be folded toward each other at respective fold lines 135*a*, 135*b*. The respective primary locking tab projections 184 can be at least partially separated from the bottom panel 138*b* along the line of weakening 183 and/or the cuts 188 and at least partially inserted into the respective openings 178 to form a primary lock 170 of the carrier 105. The respective secondary locking tab projections 181, 182 of the bottom panel 138*a* can be folded at respective fold lines 185 to extend perpendicularly upward relative to the bottom panel 138*b* for insertion into the respective slits 171, 172 and/or respective openings 179 formed by movement of the opening flaps 173, 179 relative to the bottom panel 138*a* to form a secondary lock 180 of the carrier 105. Such an arrangement of a primary lock 170 and a secondary lock 180 contributes to a substantially secure arrangement of the bottom panels 138*a*, 138*b*, for example, to resist relative movement of the bottom panels 138*a*, 138*b* such as separation and/or lateral shifting.

Figure 7:
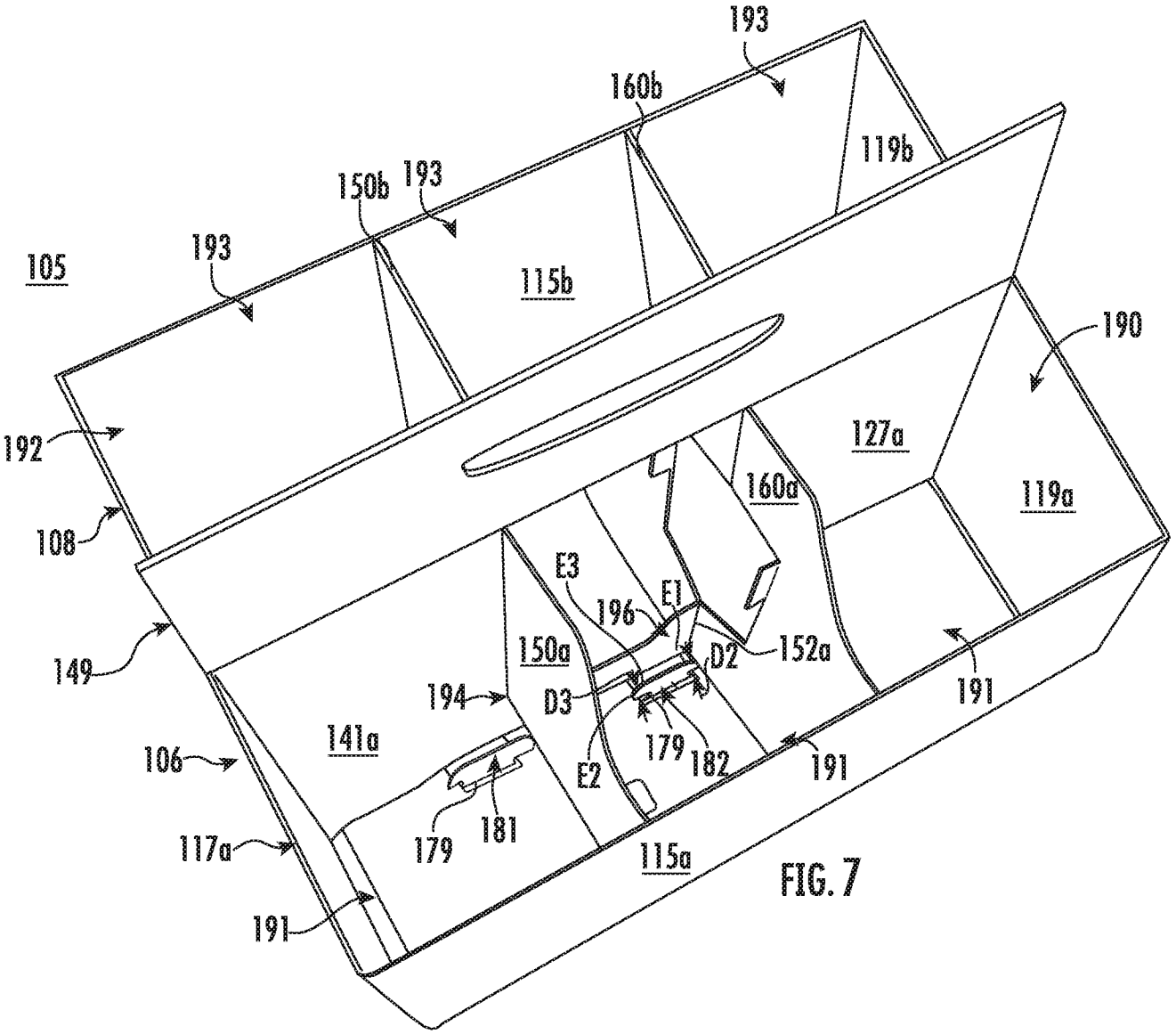
FIG. 7 is a sixth sequential perspective view of a formation of a carrier formed from the blank of FIG. 1.

Referring additionally to FIG. 7, the secondary locking tab projections 181, 182 extend upwardly through the respective slits 171, 172 and/or respective openings 179 formed by the respective opening flaps 173, 174 into the front interior space 190 of the carrier 105 in substantially upright positions. The secondary locking tab projections 181, 182, as illustrated, are positioned proximate respective interior corners 194, 196 of the front interior space 190 of the carrier 105 in the respective outermost container-receiving spaces 191. As shown, the corner 194 is formed by the central panel 141*a*, the divider flap 150*a*, and the fold line 152*a*, and the corner 196 is formed by the central panel 141*a*, the divider flap 160*a*, and the fold line 162*a*. As shown, the secondary locking tab projection 181 is positioned for at least partial face-to-face contact with the central panel 141*a* and/or the fold line 152*a* along a face thereof and the secondary locking tab projection 182 is positioned for at least partial face-to-face contact with the central panel 141*a* and/or the fold line 162*a* along a face thereof. As also shown, the secondary locking tab projection 182 includes an edge E1 positioned for engaging, e.g., contacting, the respective divider flap 160*a* and/or fold line 162*a*. As shown, the edge E1 has a substantially straight configuration, e.g., substantially parallel to the divider flap 160*a*, to maximize the area of contact between the edge E1 and the divider flap 160*a* and/or fold line 162*a*. The edge E1 can have a height D2. As shown, the secondary locking tab 182 includes a respective edge E2 opposite the edge E1. The edge E2 may be an asymmetric portion of the respective secondary locking tab projection 182 and can include a substantially straight portion having a height D3 that is different, e.g., less, than the height D2 of the edge E1. The edge E1, as shown, can be connected to each respective edge E2 by a curved edge E3 such that each secondary locking tab projection 181, 182 has an asymmetric configuration. The secondary locking tab projections 181, 182 may be otherwise shaped, arranged, and/or configured without departing from the disclosure. For example, the secondary locking tab projection 181 can have a substantially symmetric configuration, as shown, or, in one embodiment, can have an asymmetrical configuration such as the above-described configuration of the secondary locking tab projection 182. In one embodiment, one or both of the edges E1, E2 can have other than a substantially straight configuration, e.g., an oblique, angled, and/or curved configuration. The edge E3 also have other than a curved configuration, for example, straight and/or having one or more beveled, chamfered, or angled portions.

Figure 8B:
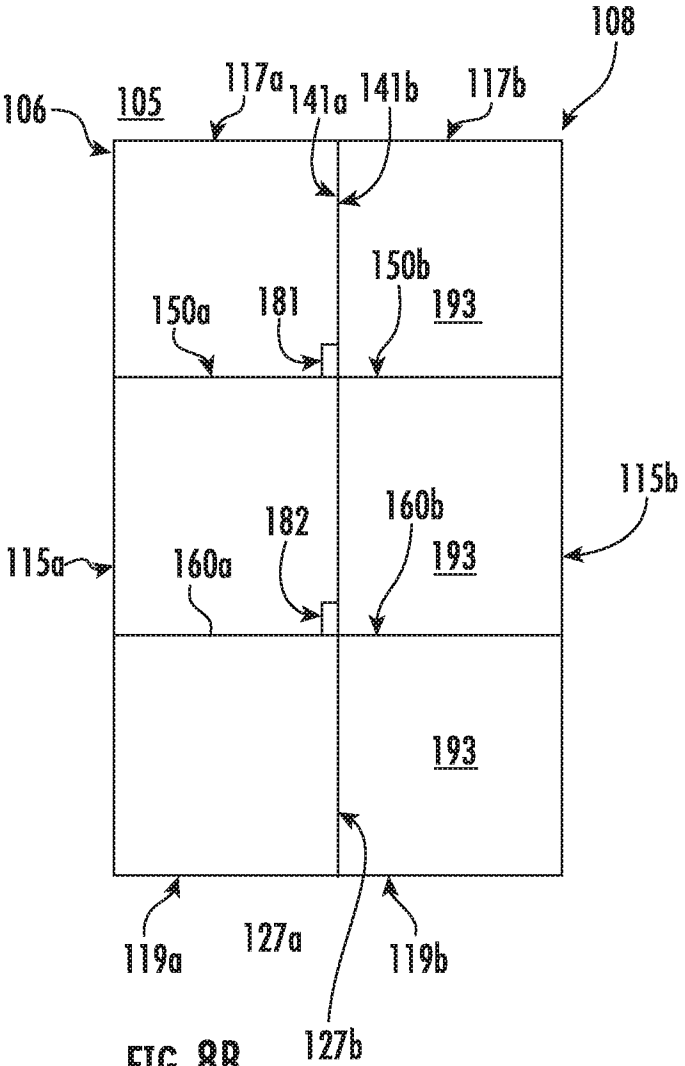
FIG. 8B is a top schematic view of the carrier formed from the blank of FIG. 1.
Figure 8A:
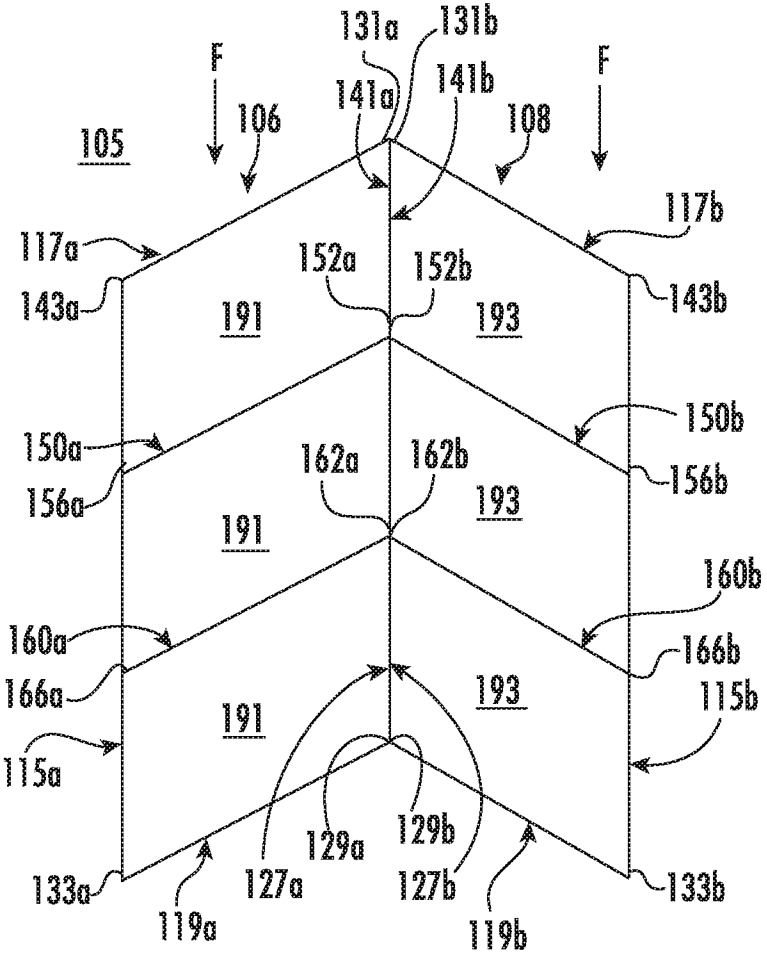
FIG. 8A is a top schematic view of the carrier formed from the blank of FIG. 1 in a partially-collapsed configuration.

Referring additionally to FIG. 8, such engagement of the secondary locking tab projection 182 with the interior corner 196 of the front interior space 190 of the carrier 105 maintains the integrity and stability of the erected condition of the carrier 105. For example, the engagement of the edge E1 of the secondary locking tab projection 182 with divider flap 160*a* at the respective corner 196 increases and/or maintains the rigidity and stiffness of the carrier 105 and locks and/or maintains the substantially, e.g., generally, perpendicular arrangement of the adhesive flaps 154*a*, 164*a*, 154*b*, 164*b* relative to the respective divider flaps 150*a*, 160*a*, 150*b*, 160*b*, the substantially perpendicular arrangement of the divider flaps 150*a*, 160*a* and 150*b*, 160*b* relative to the respective central panels 141*a*, 141*b*, and the substantially perpendicular arrangement of the side panels 117*a*, 119*a* and 117*b*, 119*b* relative to the respective front and back panels 115*a*, 115*b*. In this regard, the secondary locking tab projection 182 can inhibit movement of the carrier 105 in at least an axis A1 that extends parallel to the central panels 141*a*, 141*b* to provide dimensional stability and stiffness to the carrier 105 and may additionally inhibit movement in an axis A2 of the carrier 105 that is perpendicular to the axis A1 to provide dimensional stability and stiffness to the carrier 105, such that at least one shape-retaining feature is provided. In embodiments, dimensional stability and stiffness of the carrier 105 may be provided in one or both of a left and right direction along axis A1 (from a perspective facing the front panel 115*a*) and in one or both of a front and back direction along axis A2 (from a perspective facing the front panel 115*a*). In addition, the presence of the locking tab projection 181 through the slit 171 and/or opening 179 formed by the opening flap 173 can contribute to maintaining the integrity of the erected condition of the carrier 105. As illustrated in FIG. 8A and FIG. 8B, one or more biasing forces F toward a collapsed, e.g., at least partially folded, configuration of the carrier 105 can be generated by at least one or more of the fold lines 162*a*, 162*b*, 152*a*, 152*b*, 129*a*, 129*b*, 131*a*, 131*b*, 143*a*, 143*b*, 156*a*, 156*b*, 166*a*, 166*b*, 133*a*, 133*b* in the absence of containers in the various container receiving spaces 191, 193. However, the presence of the secondary tab projections 181, 182, e.g., the engagement of the secondary tab projection 182 with the divider flap 160*a*, can resist the one or more biasing forces bias F and maintain the erected condition of the carrier 105, e.g., prior to loading containers into the carrier 105 and/or following removal of containers from the carrier 105. In one embodiment, the secondary locking tab projection 181 can engage the corner 194.

Figure 9:
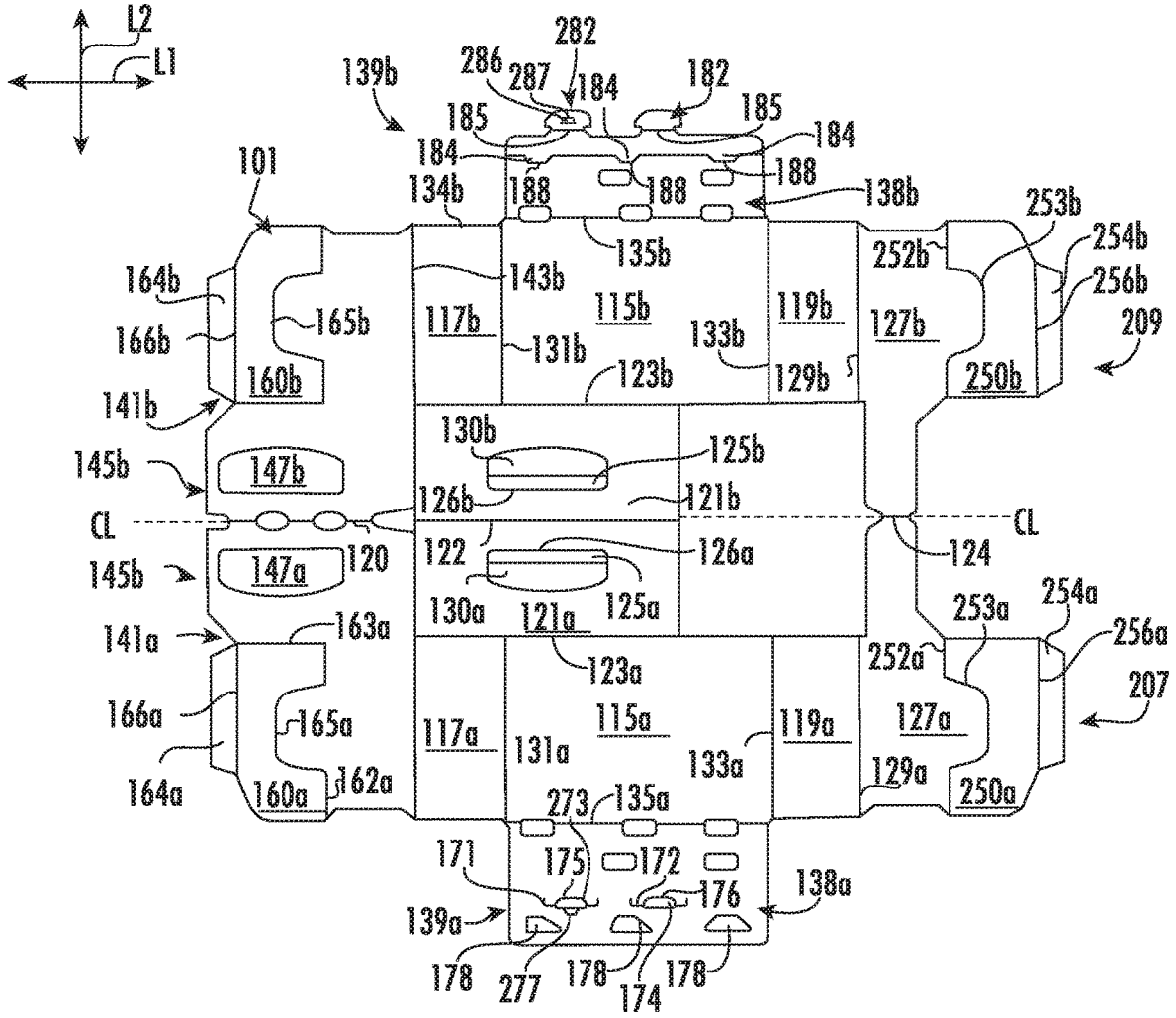
FIG. 9 is a plan view of an outer surface of a blank for forming a carrier according to a second exemplary embodiment of the disclosure.

FIG. 9 illustrates a blank 203 for forming a carrier 205 (FIG. 10) according to a second exemplary embodiment of the disclosure that includes some features that are similar to those of the first embodiment, and like or similar reference numbers are indicated throughout the drawings to indicate like or similar features. The illustrated blank 203 includes features similar to the blank 103 (FIG. 1) described above, except that respective first divider flaps 250*a*, 250*b* (broadly, "third divider flap" and "fourth divider flap", respectively) are foldably connected to the respective keels 127*a*, 127*b* at respective lateral fold lines 252*a*, 252*b* and are at least partially defined by respective lines of weakening 253*a*, 253*b* that extend along portions of the respective keels 127*a*, 127*b*. Respective adhesive flaps 254*a*, 254*b*, as shown, are foldably connected to the respective divider flaps 250*a*, 250*b* at respective lateral fold lines 256*a*, 256*b*. As also shown, the blank 203 includes a secondary tab projection 282 that has similar features as the secondary tab projection 181 (FIG. 1), and includes a locking flap 286 at least partially formed by a cut 287 that receives a projection 277 that extends from the opening flap 273.

Figure 10:
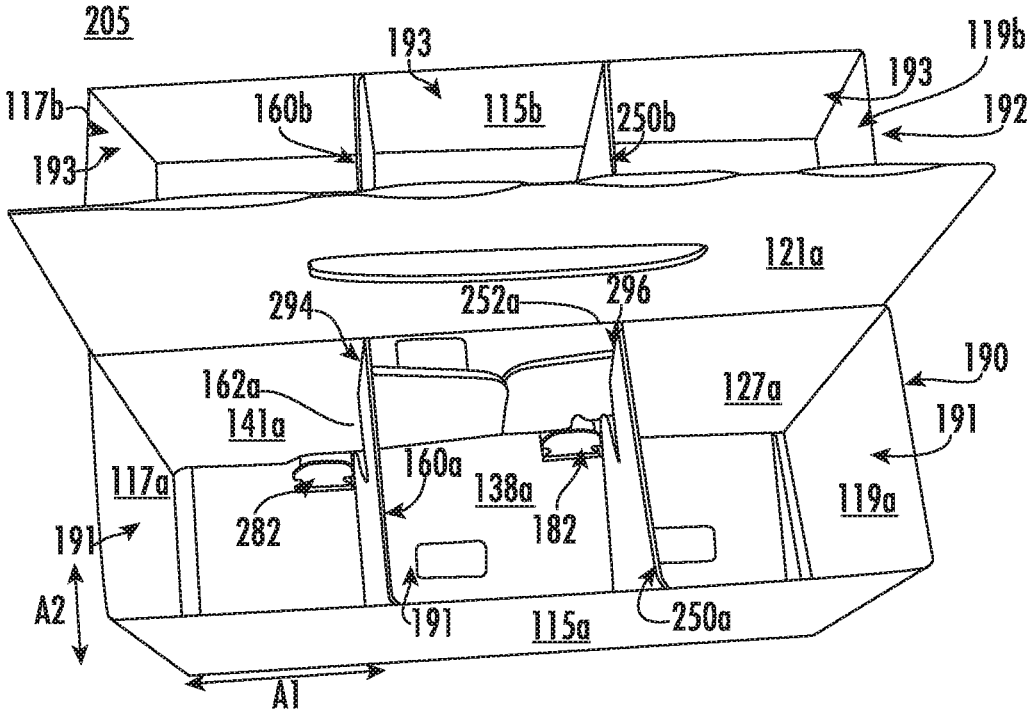
FIG. 10 is a perspective view of a carrier formed from the blank of FIG. 9.

Referring additionally to FIG. 10, the carrier 205 can be formed from the blank 203 in a similar manner to carrier 105 (FIG. 8) described above, and with the divider flaps 250*a*, 250*b* separated from the respective central panels 141*a*, 141*b* and the respective divider flaps 160*a*, 160*b* (broadly, "first divider flap" and "second divider flap", respectively) along the respective lines of weakening 253*a*, 253*b*, and with the divider flaps 160*a*, 160*b* separated from the respective central panels 141*a*, 141*b* along the respective lines of weakening 163*a*, 163*b*. The respective divider flaps 250*a*, 160*a* can be folded at the respective fold lines 252*a*, 162*a* toward the front panel 115*a* and the respective adhesive flaps 254*a*, 164*a* can be folded at the respective fold lines 256*a*, 166*a* into at least partial face-to-face contact with the front panel 115*a*, and the respective divider flaps 250*b*, 160*b* can be folded at the respective fold lines 252*b*, 162*b* toward the back panel 115*b* and the respective adhesive flaps 254*b*, 164*b* can be folded at the respective fold lines 256*b*, 166*b* into at least partial face-to-face contact with the back panel 115*b*. The adhesive flaps 254*a*, 164*a* can be secured, e.g., adhered, to the front panel 115*a* and the adhesive flaps 254*b*, 164*b* can be secured to the back panel 115*b*. In such an arrangement, the three container-receiving spaces 191 are defined in the front interior space 190 of the carrier 205 and the three container-receiving spaces 193 are defined in the back interior space 192 of the carrier 205.

Closure of the bottom of the carrier 205 can proceed as described above with respect to the previous embodiments such that the secondary locking tab projections 282, 182 extend upwardly through the respective slits 171, 172 and/or respective openings 179 formed by the respective opening flaps 273, 174 into the front interior space 190 of the carrier 305. The projection 277 of the opening flap 273, as shown, can be positioned to extend between the locking flap 286 and the cut 287 of the second locking tab projection 282, for example, to provide lateral stability to the carrier 105. The secondary locking tab projections 282, 182, as illustrated, are positioned proximate respective interior corners 294, 296 of the front interior space 190 of the carrier 205 in a respective outermost container-receiving space 191 and central container-receiving space 191. As shown, the corner 294 is formed by the central panel 141*a*, the divider flap 160*a*, and/or the fold line 162*a*, and the corner 296 is formed by the keel 127*a*, the divider flap 250*a*, and/or the fold line 252*b*. As shown, the secondary locking tab projection 282 is positioned to contact the central panel 141*a* and/or the fold line 162*a* along a face thereof and secondary locking tab projection 182 is positioned to contact the keel 127*a* and/or the fold line 252*a* along a face thereof.

Such engagement of the respective secondary locking tab projections 282, 182 with the respective interior corners 294, 296 of the front interior space 190 of the carrier 205 maintains the integrity and stability of the erected condition of the carrier 205 as described above with respect to the previous embodiments. For example, in addition to or independently of the engagement of the secondary locking tab projection 182 with the interior corner 296 of the carrier 205, engagement of the secondary locking tab projection 282 with the corner 294 of the carrier 205 inhibits movement of the carrier 205 in at least the axis A1 that extends parallel to the central panels 141*a*, 141*b* to provide dimensional stability and stiffness to the carrier 205 and may additionally inhibit movement in the axis A2 of the carrier 205 that is perpendicular to the axis A1.

Figure 11:
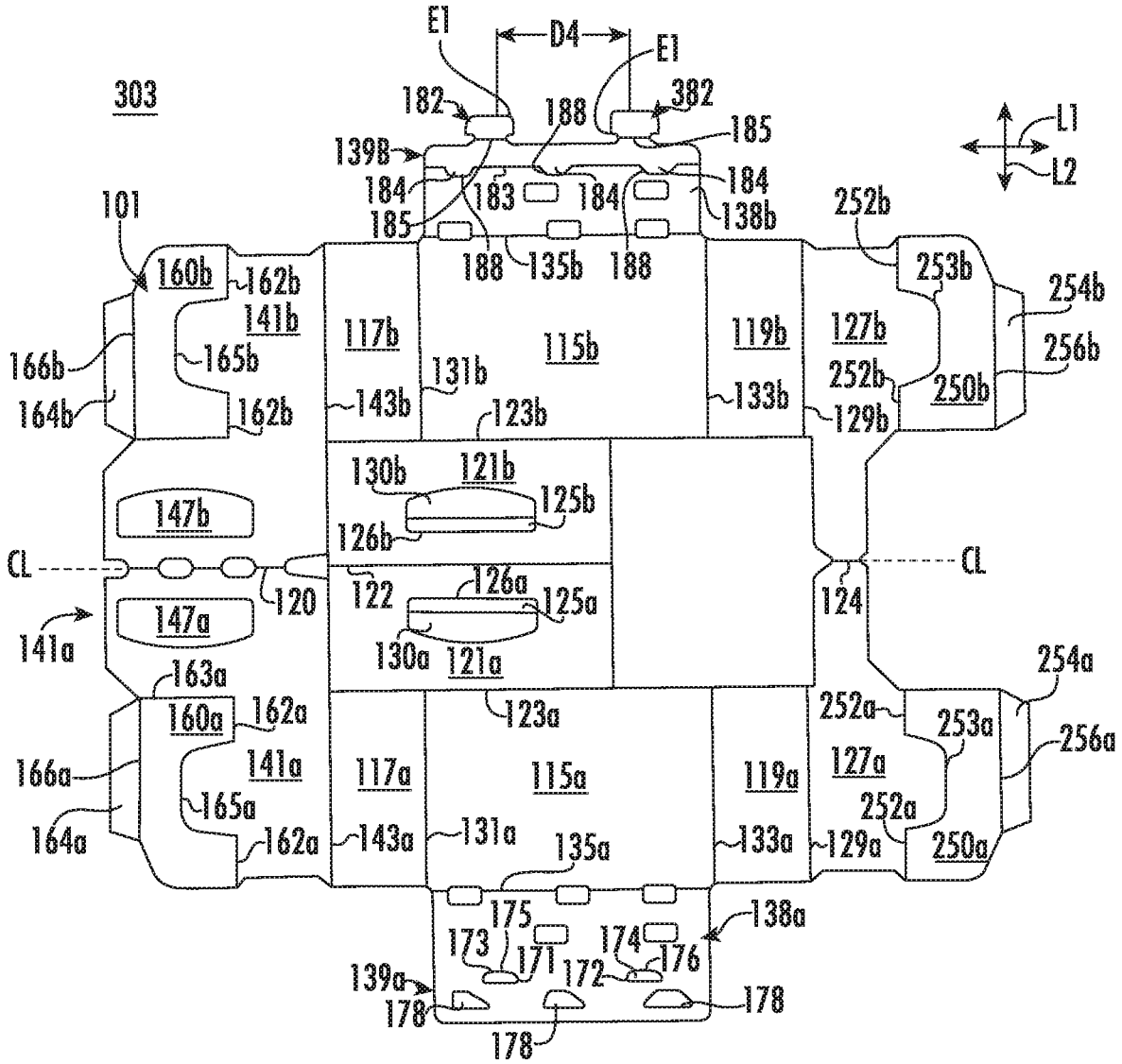
FIG. 11 is a plan view of an outer surface of a blank for forming a carrier according to a third exemplary embodiment of the disclosure.

FIG. 11 illustrates a blank 303 for forming a carrier 305 (FIG. 12) according to a third exemplary embodiment of the disclosure that includes some features that are similar to those of the first embodiment and the second embodiment, and like or similar reference numbers are indicated throughout the drawings to indicate like or similar features. The illustrated blank 303 includes features similar to the blank 203 (FIG. 9) described above, except that the secondary locking projections 182, 382 of the blank 303 are spaced apart a longitudinal distance D4 that is greater than the longitudinal distance D1 described in the blank 103 (FIG. 1) described above. The corresponding opening flaps 173, 174 are accordingly spaced apart to receive the respective secondary locking projections 182, 382. As also shown, the secondary locking tab projection 382 has a substantially similar configuration as the secondary locking tab projection 182, but has a reverse orientation along the axis L2 such that the edge E1 of the secondary locking tab projection 382 faces the edge E1 of the secondary locking tab projection 182. The blank 303 also includes the divider flaps 160*a* (broadly, "first divider flap"), 160*b* (broadly, "second divider flap"), 250*a* (broadly, "third divider flap"), 250*b* (broadly, "fourth divider flap").

Figure 12:
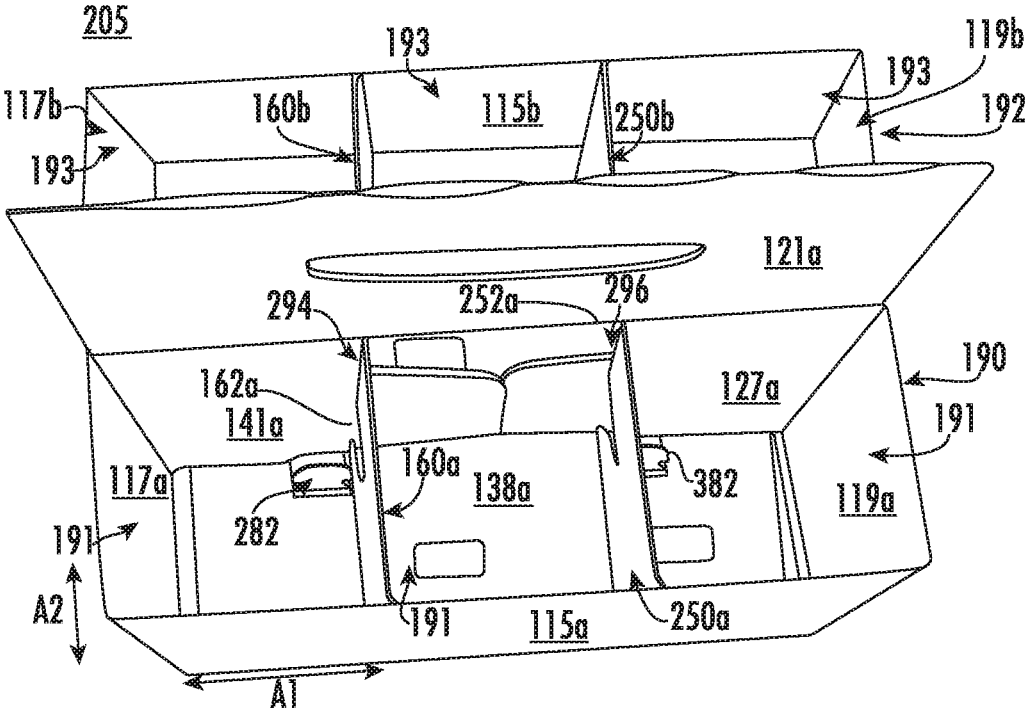
FIG. 12 is a perspective view of a carrier formed from the blank of FIG. 11.

Referring additionally to FIG. 12, the carrier 305 can be formed from the blank 303 in a similar manner to carrier 105 (FIG. 8) described above such that the secondary locking tab projections 182, 382 extend upwardly through the respective slits 171, 172 and/or respective openings 179 formed by the respective opening flaps 173, 174 into the front interior space 190 of the carrier 305. The secondary locking tab projections 182, 382, as illustrated, are positioned proximate respective interior corners 394, 396 of the front interior space 190 of the carrier 105 in a respective outermost container-receiving space 191 and a central container-receiving space 191. As shown, the corner 394 is formed by the central panel 141*a*, the divider flap 160*a*, and/or the fold line 162*a*, and the corner 396 is formed by the keel 127*a*, the divider flap 250*a*, and/or the fold line 252*b*. As illustrated, the secondary locking tab projection 182 is positioned to contact the central panel 141*a* and/or the fold line 162*a* along a face thereof and the secondary locking tab projection 382 is positioned to contact the keel 127*a* and/or the fold line 252*b* along a face thereof.

Such engagement of the respective secondary locking tab projections 182, 382 with the respective interior corners 394, 396 of the front interior space 190 of the carrier 305 maintains the integrity and stability of the erected condition of the carrier 305 as described above with respect to the previous embodiments. For example, in addition to or independently of the engagement of the secondary locking tab projection 182 with the corner 384 of the carrier 305, engagement of the secondary locking tab projection 382 with the corner 396 of the carrier 305 inhibits bi-directional movement of the carrier 305 at least along the axis A1 that extends parallel to the central panels 141*a*, 141*b* to provide dimensional stability and stiffness to the carrier 305, and may additionally inhibit movement in the axis A2 of the carrier 305 that is perpendicular to the axis A1.

Carriers and blanks as described herein could be otherwise shaped and/or arranged without departing from the disclosure. For example, carriers and blanks may contain a single secondary locking tab projection or more than two secondary locking tab projections. In one embodiment, the secondary tab projection 181 (FIG. 1) of the carrier 105 (FIG. 8) can include the locking flap 286 formed by the cut 287 (FIG. 9), and the carrier 105 can include the corresponding opening flap 273 (FIG. 9) that includes the projection 277 for extending between the locking flap 286 and the cut 287.

In general, the blank may be constructed from paperboard having a caliper so that it is heavier and more rigid than ordinary paper. The blank can also be constructed of other materials, such as cardboard, or any other material having properties suitable for enabling the carrier to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carrier embodiments. The term "glue" is intended to encompass all manner of adhesives commonly used to secure carrier panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for holding at least one container, the carrier comprising:

a plurality of panels extending at least partially around an interior space of the carrier, the plurality of panels comprises a front panel, a back panel, at least one side panel, a first bottom panel, a second bottom panel, and at least one central panel; and at least one divider flap extending from the at least one central panel to at least one of the front panel and the back panel, the first bottom panel includes at least one male locking feature and the second bottom panel includes at least one female locking feature for receiving the at least one male locking feature, the at least one male locking feature engages the at least one divider flap to lock the at least one divider flap in a generally perpendicular position relative to the central panel.

2. The carrier of claim 1, wherein the at least one male locking feature is in a substantially upright position in the interior space of the carrier.

3. The carrier of claim 1, wherein the at least one male locking feature comprises a substantially straight edge for engaging the at least one divider flap.

4. The carrier of claim 3, wherein the substantially straight edge is a first edge having a first height, and the at least one male locking feature comprises a second edge opposite the first edge and having a second height, the first height is different than the second height.

5. The carrier of claim 4, wherein the first edge and the second edge are connected by a curved edge.

6. The carrier of claim 3, wherein the at least one male locking feature is in at least partial face-to-face contact with the at least one central panel.

7. The carrier of claim 3, wherein the plurality of panels comprises at least one keel positioned generally coplanar to the at least one central panel, and the at least one male locking feature is in at least partial face-to-face contact with the at least one keel.

8. The carrier of claim 1, wherein the at least one divider flap comprises a first divider flap and a second divider flap, and the at least one male locking feature comprises a first male locking feature positioned to engage the first divider flap and a second male locking feature positioned to engage the second divider flap.

9. The carrier of claim 1, wherein the at least one male locking feature is positioned proximate a corner formed by the at least one divider flap and the at least one central panel.

10. The carrier of claim 1, wherein the plurality of panels comprises at least one keel positioned generally coplanar to the central panel, and the at least one male locking feature is positioned proximate a corner formed by the at least one divider flap and the at least one keel.

11. The carrier of claim 1, wherein the engagement of the at least one male locking feature and the at least one female locking feature forms a secondary lock of the carrier, and the second bottom panel comprises at least one opening for receiving at least one locking tab projection of the first bottom panel, engagement of the at least one locking tab projection with the at least one opening forms a primary lock of the carrier.

12. The carrier of claim 1, wherein the at least one central panel comprises a front central panel in at least partial face-to-face contact with a back central panel, and the at least one divider flap comprises a first divider flap extending from the front central panel to the front panel and a second divider flap extending from the back central panel to the back panel.

13. The carrier of claim 12, wherein the at least one divider flap comprises a third divider flap extending from the front central panel to the front panel and a fourth divider flap extending from the back central panel to the back panel.

14. The carrier of claim 13, wherein the first divider flap and the third divider flap define three front container-receiving spaces in the interior space of the carrier and the second divider flap and the fourth divider flap define three back container-receiving spaces in the interior space of the carrier, wherein the at least one male locking feature is positioned in a central front container-receiving space of the three front container-receiving spaces, the at least one male locking feature engages the first divider flap.

15. The carrier of claim 14, wherein the at least one male locking feature is a first male locking feature, and the at least one male locking feature comprises a second male locking feature positioned in an outermost front container-receiving space of the three front container-receiving spaces.

16. The carrier of claim 12, wherein the plurality of panels comprises a front keel and a back keel in at least partial face-to-face contact, and the at least one divider flap comprises a third divider flap extending from the front keel to the front panel and a fourth divider flap extending from the back keel to the back panel.

17. The carrier of claim 16, wherein the first divider flap and the third divider flap define three front container-receiving spaces in the interior space of the carrier and the second divider flap and the fourth divider flap define three back container-receiving spaces in the interior space of the carrier, wherein the at least one male locking feature is positioned in a central container-receiving space of the three front container-receiving spaces, the at least one male locking feature engages the third divider flap.

18. The carrier of claim 17, wherein the at least one male locking feature is a first male locking feature, and the at least one male locking feature comprises a second male locking feature positioned in an outermost container-receiving space of the three front container-receiving spaces, the second male locking feature engages the first divider flap.

19. The carrier of claim 16, wherein the first divider flap and the third divider flap define three front container-receiving spaces in the interior space of the carrier and the second divider flap and the fourth divider flap define three back container-receiving spaces in the interior space of the carrier, wherein the at least one male locking feature is positioned in an outermost front container-receiving space of the three front container-receiving spaces, the at least one male locking feature engages the first divider flap.

20. The carrier of claim 19, wherein the at least one male locking feature is a first male locking feature, the outermost front container-receiving space is a first outermost front container-receiving space, the at least one male locking feature comprises a second male locking feature positioned in a second outermost container-receiving space of the three front container-receiving spaces, the second male locking feature engages the third divider flap.

21. The carrier of claim 1, wherein engagement of the at least one male locking feature with the at least one divider flap at least partially inhibits movement of the carrier along an axis extending parallel to the at least one central panel.

22. The carrier of claim 21, wherein the at least one male locking feature comprises a face positioned for at least partial face-to-face contact with the at least one central panel, and wherein engagement of the at least one male locking feature with the at least one central panel at least partially inhibits movement of the carrier along an axis perpendicular to the axis extending parallel to the at least one central panel.

23. A blank for forming a carrier for holding at least one container, the blank comprising:

a plurality of panels for extending at least partially around an interior space of the carrier formed from the blank, the plurality of panels comprises a front panel, a back panel, at least one side panel, a first bottom panel, a second bottom panel, and at least one central panel; and at least one divider flap for extending from the at least one central panel to at least one of the front panel and the back panel in the carrier formed from the blank, the first bottom panel includes at least one male locking feature and the second bottom panel includes at least one female locking feature for receiving the at least one male locking feature in the carrier formed from the blank, the at least one male locking feature is for engagement with the at least one divider flap to lock the at least one divider flap in a generally perpendicular position relative to the central panel in the carrier formed from the blank.

24. The blank of claim 23, wherein the at least one male locking feature is for being positioned in a substantially upright position in the interior space of the carrier formed from the blank.

25. The blank of claim 23, wherein the at least one male locking feature comprises a substantially straight edge for engaging the at least one divider flap in the carrier formed from the blank.

26. The blank of claim 25, wherein the substantially straight edge is a first edge having a first height, and the at least one male locking feature comprises a second edge opposite the first edge and having a second height, the first height is different than the second height.

27. The blank of claim 26, wherein the first edge and the second edge are connected by a curved edge.

28. The blank of claim 25, wherein the at least one male locking feature is for being positioned in at least partial face-to-face contact with the at least one central panel in the carrier formed from the blank.

29. The blank of claim 25, wherein the plurality of panels comprises at least one keel for being positioned generally coplanar to the at least one central panel in the carrier formed from the blank, and the at least one male locking feature is for being positioned in at least partial face-to-face contact with the at least one keel in the carrier formed from the blank.

30. The blank of claim 23, wherein the at least one divider flap comprises a first divider flap and a second divider flap, and the at least one male locking feature comprises a first male locking feature for being positioned to engage the first divider flap in the carrier formed from the blank and a second male locking feature for being positioned to engage the second divider flap in the carrier formed from the blank.

31. The blank of claim 23, wherein the at least one male locking feature is for being positioned proximate a corner formed by the at least one divider flap and the at least one central panel in the carrier formed from the blank.

32. The blank of claim 23, wherein the plurality of panels comprises at least one keel for being positioned generally coplanar to the central panel in the carrier formed from the blank, and the at least one male locking feature is for being positioned proximate a corner formed by the at least one divider flap and the at least one keel in the carrier formed from the blank.

33. The blank of claim 23, wherein the engagement of the at least one male locking feature and the at least one female locking feature forms a secondary lock of the carrier formed from the blank, and the second bottom panel comprises at least one opening for receiving at least one locking tab projection of the first bottom panel, engagement of the at least one locking tab projection with the at least one opening forms a primary lock of the carrier formed from the blank.

34. The blank of claim 23, wherein the at least one central panel comprises a front central panel for being in at least partial face-to-face contact with a back central panel in the carrier formed from the blank, and the at least one divider flap comprises a first divider flap extending from the front central panel to the front panel and a second divider flap extending from the back central panel to the back panel in the carrier formed from the blank.

35. The blank of claim 34, wherein the at least one divider flap comprises a third divider flap extending from the front central panel to the front panel and a fourth divider flap extending from the back central panel to the back panel in the carrier formed from the blank.

36. The blank of claim 35, wherein the first divider flap and the third divider flap define three front container-receiving spaces in the interior space of the carrier formed from the blank and the second divider flap and the fourth divider flap define three back container-receiving spaces in the interior space of the carrier formed from the blank, wherein the at least one male locking feature is for being positioned in a central front container-receiving space of the three front container-receiving spaces of the carrier formed from the blank, the at least one male locking feature is for engaging the first divider flap in the carrier formed from the blank.

37. The blank of claim 36, wherein the at least one male locking feature is a first male locking feature, and the at least one male locking feature comprises a second male locking feature for being positioned in an outermost front container-receiving space of the three front container-receiving spaces in the carrier formed from the blank.

38. The blank of claim 34, wherein the plurality of panels comprises a front keel and a back keel for being in at least partial face-to-face contact in the carrier formed from the blank, and the at least one divider flap comprises a third divider flap extending from the front keel to the front panel and a fourth divider flap extending from the back keel to the back panel in the carrier formed from the blank.

39. The blank of claim 38, wherein the first divider flap and the third divider flap define three front container-receiving spaces in the interior space of the carrier formed from the blank and the second divider flap and the fourth divider flap define three back container-receiving spaces in the interior space of the carrier formed from the blank, wherein the at least one male locking feature is for being positioned in a central container-receiving space of the three front container-receiving spaces in the carrier formed from the blank, the at least one male locking feature is for engaging the third divider flap in the carrier formed from the blank.

40. The blank of claim 39, wherein the at least one male locking feature is a first male locking feature, and the at least one male locking feature comprises a second male locking feature for being positioned in an outermost container-receiving space of the three front container-receiving spaces in the carrier formed from the blank, the second male locking feature engages the first divider flap in the carrier formed from the blank.

41. The blank of claim 38, wherein the first divider flap and the third divider flap define three front container-receiving spaces in the interior space of the carrier formed from the blank and the second divider flap and the fourth divider flap define three back container-receiving spaces in the interior space of the carrier formed from the blank, wherein the at least one male locking feature is positioned in an outermost front container-receiving space of the three front container-receiving spaces in the carrier formed from the blank, the at least one male locking feature engages the first divider flap in the carrier formed from the blank.

42. The blank of claim 41, wherein the at least one male locking feature is a first male locking feature, the outermost front container-receiving space is a first outermost front container-receiving space in the carrier formed from the blank, the at least one male locking feature comprises a second male locking feature positioned in a second outermost container-receiving space of the three front container-receiving spaces in the carrier formed from the blank, the second male locking feature engages the third divider flap in the carrier formed from the blank.

43. The blank of claim 23, wherein engagement of the at least one male locking feature with the at least one divider flap at least partially inhibits movement of the carrier formed from the blank along an axis extending parallel to the at least one central panel.

44. The blank of claim 43, wherein the at least one male locking feature comprises a face for being positioned in at least partial face-to-face contact with the at least one central panel in the carrier formed from the blank, and wherein engagement of the at least one male locking feature with the at least one central panel at least partially inhibits movement of the carrier formed from the blank along an axis perpendicular to the axis extending parallel to the at least one central panel.

45. A method of forming a carrier for holding at least one container, the method comprising:

obtaining a blank comprising a plurality of panels, the plurality of panels comprises a front panel, a back panel, at least one side panel, a first bottom panel, a second bottom panel, and at least one central panel, the plurality of panels comprises at least one divider flap, the first bottom panel includes at least one male locking feature and the second bottom panel includes at least one female locking feature;

arranging the plurality of panels to extend at least partially around an interior space of the carrier;

positioning the at least one divider flap to extend from the at least one central panel to at least one of the front panel and the back panel; and inserting the at least one male locking feature at least partially through the at least one female locking feature to engage the at least one divider flap.

46. The method of claim 45, wherein the at least one male locking feature is positioned in a substantially upright position in the interior space of the carrier.

47. The method of claim 45, wherein the at least one male locking feature comprises a substantially straight edge for engaging the at least one divider flap.

48. The method of claim 47, wherein the substantially straight edge is a first edge having a first height, and the at least one male locking feature comprises a second edge opposite the first edge and having a second height, the first height is different than the second height.

49. The method of claim 48, wherein the first edge and the second edge are connected by a curved edge.

50. The method of claim 47, wherein the at least one male locking feature is in at least partial face-to-face contact with the at least one central panel.

51. The method of claim 47, wherein the plurality of panels comprises at least one keel positioned generally coplanar to the at least one central panel, and the at least one male locking feature is in at least partial face-to-face contact with the at least one keel.

52. The method of claim 45, wherein the at least one divider flap comprises a first divider flap and a second divider flap, and the at least one male locking feature comprises a first male locking feature positioned to engage the first divider flap and a second male locking feature positioned to engage the second divider flap.

53. The method of claim 45, wherein the at least one male locking feature is positioned proximate a corner formed by the at least one divider flap and the at least one central panel.

54. The method of claim 45, wherein the plurality of panels comprises at least one keel positioned generally coplanar to the central panel, and the at least one male locking feature is positioned proximate a corner formed by the at least one divider flap and the at least one keel.

55. The method of claim 45, wherein the engagement of the at least one male locking feature and the at least one female locking feature forms a secondary lock of the carrier, and the second bottom panel comprises at least one opening for receiving at least one locking tab projection of the first bottom panel, engagement of the at least one locking tab projection with the at least one opening forms a primary lock of the carrier.

56. The method of claim 45, wherein the at least one central panel comprises a front central panel in at least partial face-to-face contact with a back central panel, and the at least one divider flap comprises a first divider flap extending from the front central panel to the front panel and a second divider flap extending from the back central panel to the back panel.

57. The method of claim 56, wherein the at least one divider flap comprises a third divider flap extending from the front central panel to the front panel and a fourth divider flap extending from the back central panel to the back panel.

58. The method of claim 57, wherein the first divider flap and the third divider flap define three front container-receiving spaces in the interior space of the carrier and the second divider flap and the fourth divider flap define three back container-receiving spaces in the interior space of the carrier, wherein the at least one male locking feature is positioned in a central front container-receiving space of the three front container-receiving spaces, the at least one male locking feature engages the first divider flap.

59. The method of claim 58, wherein the at least one male locking feature is a first male locking feature, and the at least one male locking feature comprises a second male locking feature positioned in an outermost front container-receiving space of the three front container-receiving spaces.

60. The method of claim 56, wherein the plurality of panels comprises a front keel and a back keel in at least partial face-to-face contact, and the at least one divider flap comprises a third divider flap extending from the front keel to the front panel and a fourth divider flap extending from the back keel to the back panel.

61. The method of claim 60, wherein the first divider flap and the third divider flap define three front container-receiving spaces in the interior space of the carrier and the second divider flap and the fourth divider flap define three back container-receiving spaces in the interior space of the carrier, wherein the at least one male locking feature is positioned in a central container-receiving space of the three front container-receiving spaces, the at least one male locking feature engages the third divider flap.

62. The method of claim 61, wherein the at least one male locking feature is a first male locking feature, and the at least one male locking feature comprises a second male locking feature positioned in an outermost container-receiving space of the three front container-receiving spaces, the second male locking feature engages the first divider flap.

63. The method of claim 60, wherein the first divider flap and the third divider flap define three front container-receiving spaces in the interior space of the carrier and the second divider flap and the fourth divider flap define three back container-receiving spaces in the interior space of the carrier, wherein the at least one male locking feature is positioned in an outermost front container-receiving space of the three front container-receiving spaces, the at least one male locking feature engages the first divider flap.

64. The method of claim 63, wherein the at least one male locking feature is a first male locking feature, the outermost front container-receiving space is a first outermost front container-receiving space, the at least one male locking feature comprises a second male locking feature positioned in a second outermost container-receiving space of the three front container-receiving spaces, the second male locking feature engages the third divider flap.

65. The method of claim 45, wherein engagement of the at least one male locking feature with the at least one divider flap at least partially inhibits movement of the carrier along an axis extending parallel to the at least one central panel.

66. The method of claim 65, wherein the at least one male locking feature comprises a face positioned for at least partial face-to-face contact with the at least one central panel, and wherein engagement of the at least one male locking feature with the at least one central panel at least partially inhibits movement of the carrier along an axis perpendicular to the axis extending parallel to the at least one central panel.

* * * * *